US005601412A

United States Patent [19]

Vice

[11] Patent Number: 5,601,412

[45] Date of Patent: Feb. 11, 1997

[54] VARIABLE SIZE CIRCULAR FAN GUARD

[76] Inventor: Stephen D. Vice, 1730 Ratliff Rd., Sharpsburg, Ky. 40374

[21] Appl. No.: 550,986

[22] Filed: Oct. 31, 1995

[51] Int. Cl.[6] ..... F04D 29/66

[52] U.S. Cl. ..... 416/247 R; 416/2

[58] Field of Search ..... 416/2, 5, 247 R

[56] References Cited

U.S. PATENT DOCUMENTS

| | | | |
|---|---|---|---|
| 515,405 | 2/1894 | Meston | 416/247 R |
| 1,228,853 | 6/1917 | Varley | 416/247 R |
| 1,889,567 | 11/1932 | Persons | 416/5 |
| 3,620,644 | 11/1971 | McLarty | 416/247 R |
| 4,356,535 | 10/1982 | Chu | 416/247 R |
| 4,818,183 | 4/1989 | Schaefer | 416/247 R |

*Primary Examiner*—Edward K. Look
*Assistant Examiner*—Mark Sgantzos
*Attorney, Agent, or Firm*—Terrance L. Siemens

[57] ABSTRACT

A fan guard for, the guard having an easily adjustable diameter and a fence for protecting people and objects from coming into contact with the rotating fan blades. The frame of the fan guard includes notches within the frame that allow the user to disconnect portions of the fan guard so that the diameter of the fan guard can be made to approximately match the diameter of a circle formed by the ends of the fan blades as the fan blades rotate.

10 Claims, 3 Drawing Sheets

VARIABLE SIZE CIRCULAR FAN GUARD

BACKGROUND OF THE INVENTION

1. Field of the Invention

This invention relates to fan guards, and more particularly to a variable size fan guard used for ceiling fans.

2. Brief Description of the Prior Art

Fan guards are well known for use with portable fans to protect people and objects from coming into contact with the rotating fan blades. In addition, there are fan blades specifically designed for use with ceiling fans. Like guards for portable fans, the ceiling fan guard is designed to protect people or objects from coming into contact with the rotating blades of the ceiling fan.

U.S. Pat. No. 4,657,485 issued to Hartwig on Apr. 14, 1987 discloses a circular ceiling fan guard including a circular guard portion positioned below the rotating fan blades. The fan guard is held in place by supporting wires affixed to the outer perimeter of the circular guard and distal ends of arms. The arms are affixed above the fan blades. The wires are used to hold in place and support the circular fan guard. By contrast, the instant invention discloses means for adjusting the size of the fan guard so as to accommodate a plurality of potential fan guard sizes.

U.S. Pat. No. 3,787,142 issued to Dupkc on Jan. 22, 1974 discloses a circular fan guard wherein the guarding portion covers all sides of the rotating fan blades. The guard includes peripheral wires which secure the fan guard in place. However, the fan guard is not disclosed as exclusively being used for ceiling fans.

U.S. Pat. No. 4,064,427 issued to Hansen et al. on Dec. 20, 1977 discloses a ceiling fan guard including a perimeter decorative covering running the perimeter of a circle formed by the distal ends of the fan blades. The covering is secured in place by chains affixed to the base of the ceiling fan. However, there is no physical guard directly below the fan blades.

U.S. Pat. No. 4,515,538 issued to Shih on May 7, 1985 discloses a ceiling fan guard which surrounds the entirety of the ceiling fan. Below the fan blades is situated a grating. The grating is affixed to a frame via adjustable means. The frame is affixed to the ceiling above the ceiling fan, however, in contrast to the instant invention, the frame itself is not adjustable to accommodate application to a plurality of different size ceiling fans.

It will be noted that all the prior art devices are applicable to only one size of circular ceiling fan. This limited use limits the applicability of the prior art fan guards and precludes adjustments by the user to individual needs of particular ceiling fans.

None of the above inventions and patents, taken either singly or in combination, is seen to describe the instant invention as claimed. Neither the prior art in general, and none of these patents in particular, discloses a ceiling fan with an adjustable perimeter to accommodate a plurality of different size ceiling fans.

SUMMARY OF THE INVENTION

It is therefore an object of the present invention to provide an improved guard for conventional ceiling fans.

It is another object of the present invention to provide a ceiling fan guard having an adjustable perimeter to accommodate the perimeter of ceiling fan as defined by the distal ends of the fan blades.

It is another object of the present invention to provide a ceiling fan guard having an easily adjustable diameter.

It is another object of the present invention to provide a ceiling fan guard which is simple to construct and economical to manufacture.

It is another object of the present invention to provide a variable size ceiling fan guard having a fence to further guard against any contact with the ceiling fan blades.

Other objects of the invention will become apparent to one skilled in the art throughout the specification and claims as hereinafter related.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
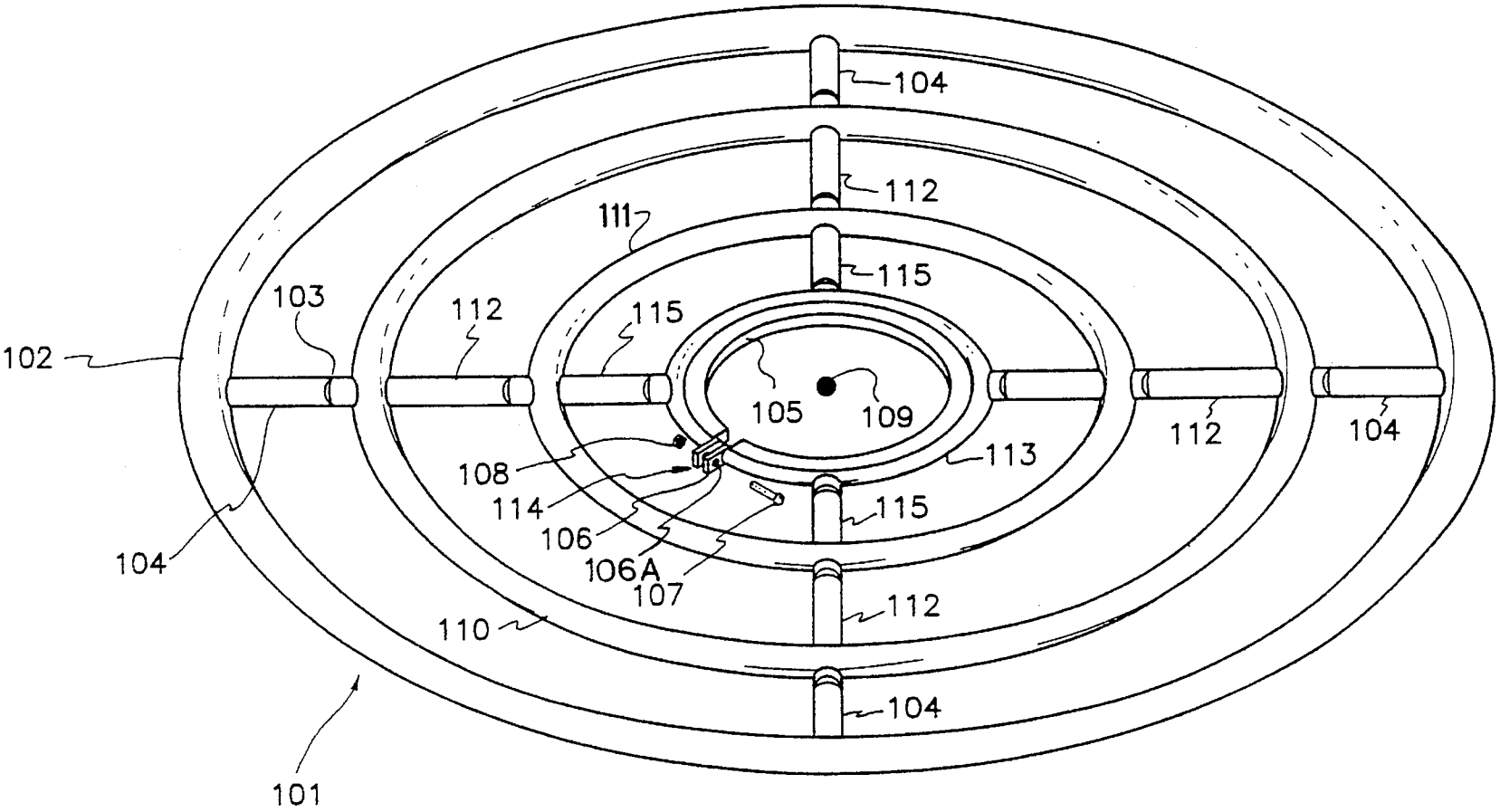
FIG. 1 depicts a top view of an embodiment of a circular fan guard according to the invention.
Figure 2:
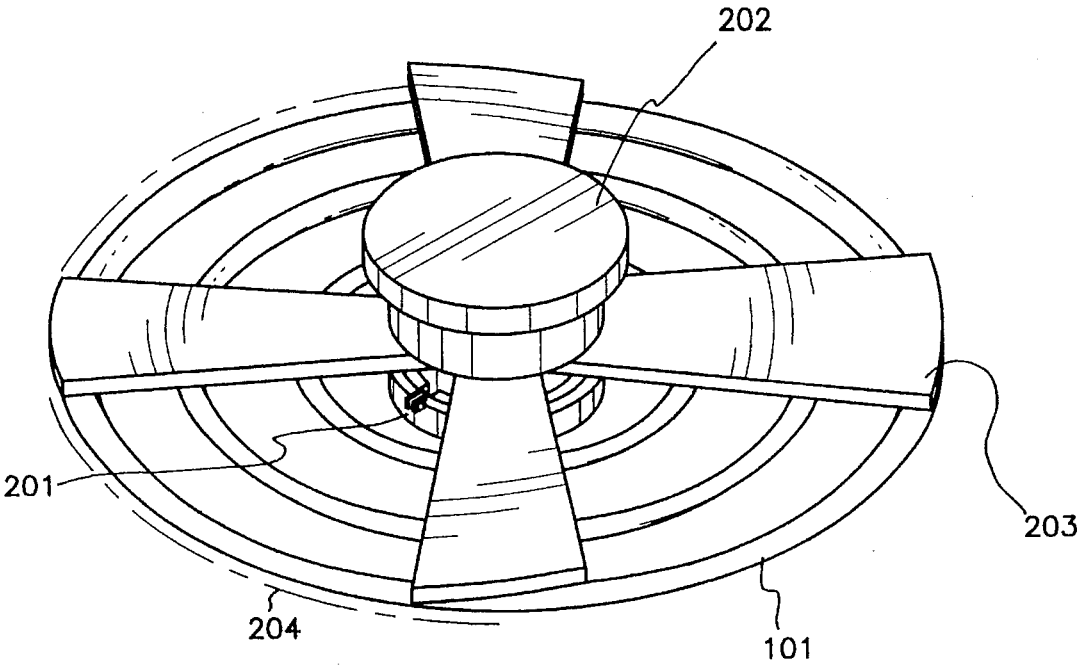
FIG. 2 depicts a top view of an embodiment of a circular fan guard affixed to a ceiling fan.

FIG. 1 discloses a circular fan guard 101 which is positioned below a ceiling fan (202 as shown in FIG. 2). The circular fan guard includes a circular body having generally circular rings 102, 110 and 111 centered about a point 109. As depicted in FIG. 1, the circular guard comprises three circular rings of different radii, however, the invention is not limited to three circular rings and may comprise a one or many rings. The rings are separated by sets of linear radial spacers 104, 112 and 115. The linear radial spacers extend along one of four lines originating at center point 109 and running to the outer most ring perimeter (102 of FIG. 1). Linear radial spacers hold rings 102, 110, and 111 concentrically spaced apart from one another, and secured to an attachment member 113. As depicted in FIG. 1, ring 102 is secured to ring 110 by means of linear radial spacers 104. Likewise, ring 110 is secured to ring 111 by means of linear radial spacers 112. Finally, ring 111 is secured to attachment member 113 by means of linear radial spacers 115.

The liner radial spacers include at least one notch positioned within the liner spacer. The notch extends approximately midway through the width of the linear radial spacer to provide a point of breakage for the spacer while not compromising the integrity of the linear radial spacer's pieces. All notches are equidistant from a distal end of the linear radial spacer. In application, when a set of linear radial spacers are broken at the notches, the outer most ring, lacking support, will come loose and remove easily, thereby shortening the overall diameter of the fan guard.

Attachment member 113 of circular fan guard 101 is split or broken. This break creates two opposing ends, each having a flange 106. Flanges 106 extend perpendicularly outwardly from both these ends. Each flange 106 includes a hole 106A extending therethrough. Hole 106A accommodates a bolt 107 and nut 108 fastening combination.

Although depicted as a nut and bolt type fastening combination, the invention is not limited to this type of fastening means and may incorporate any combination known in the art. Attachment member 113 also includes a gasket 105 extending along inner perimeter 114 of attachment member 113. Gasket 105 is made of a flexible material such as rubber or plastic and is used to take up the slack when fastening the fan guard to the ceiling fan.

In the installation procedure, the circular fan guard is affixed to a ceiling fan as shown in FIG. 2. As depicted, nut 108 and bolt 107 are fastened together at 201 thereby securing the fan guard 101 to the base of a ceiling fan 202. As further shown, the diameter of the fan guard 101 approximates the diameter of a circle 204 created by the rotation of the distal ends of the ceiling fan blades 203. Should the diameter of the fan guard be larger than the circle created by the angular rotation of fan blades, the fan guard diameter can be shortened.

Figure 3:
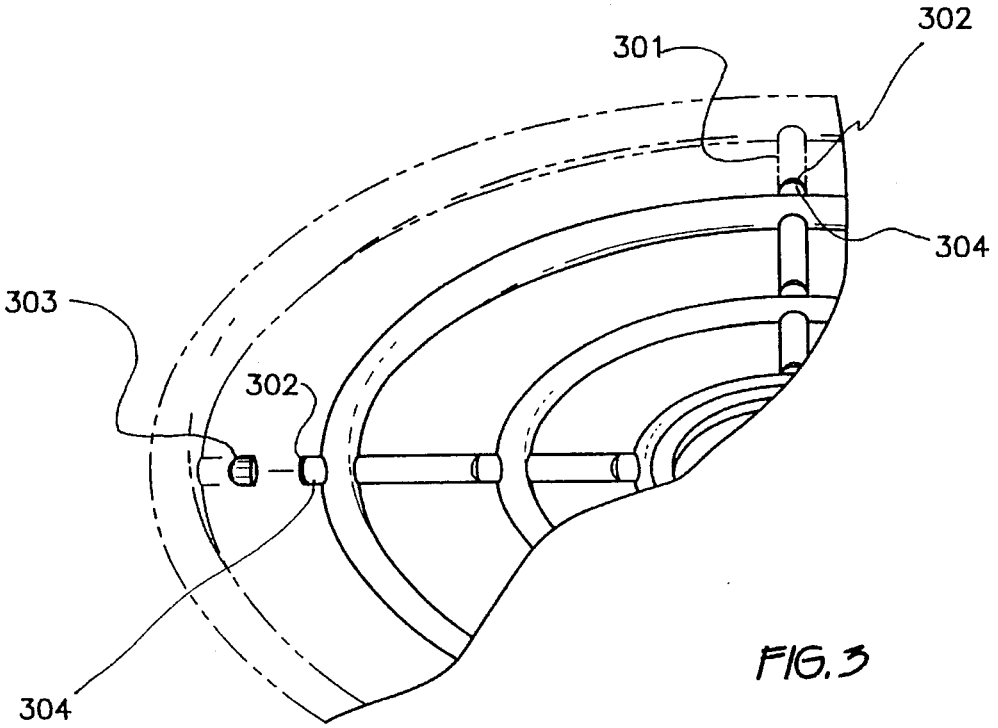
FIG. 3 depicts a partial view of an embodiment of a circular fan guard with detached outer ring.

The shortening procedure is depicted in FIG. 3. As shown, the linear radial spacer 304 is broken at the notch location 302 and the remaining portion of the linear radial spacer 304 is secured with a cover 301. Cover 301 may be composed of any flexible material including, but not limited to plastic, rubber, cloth, and metal.

Figure 4:
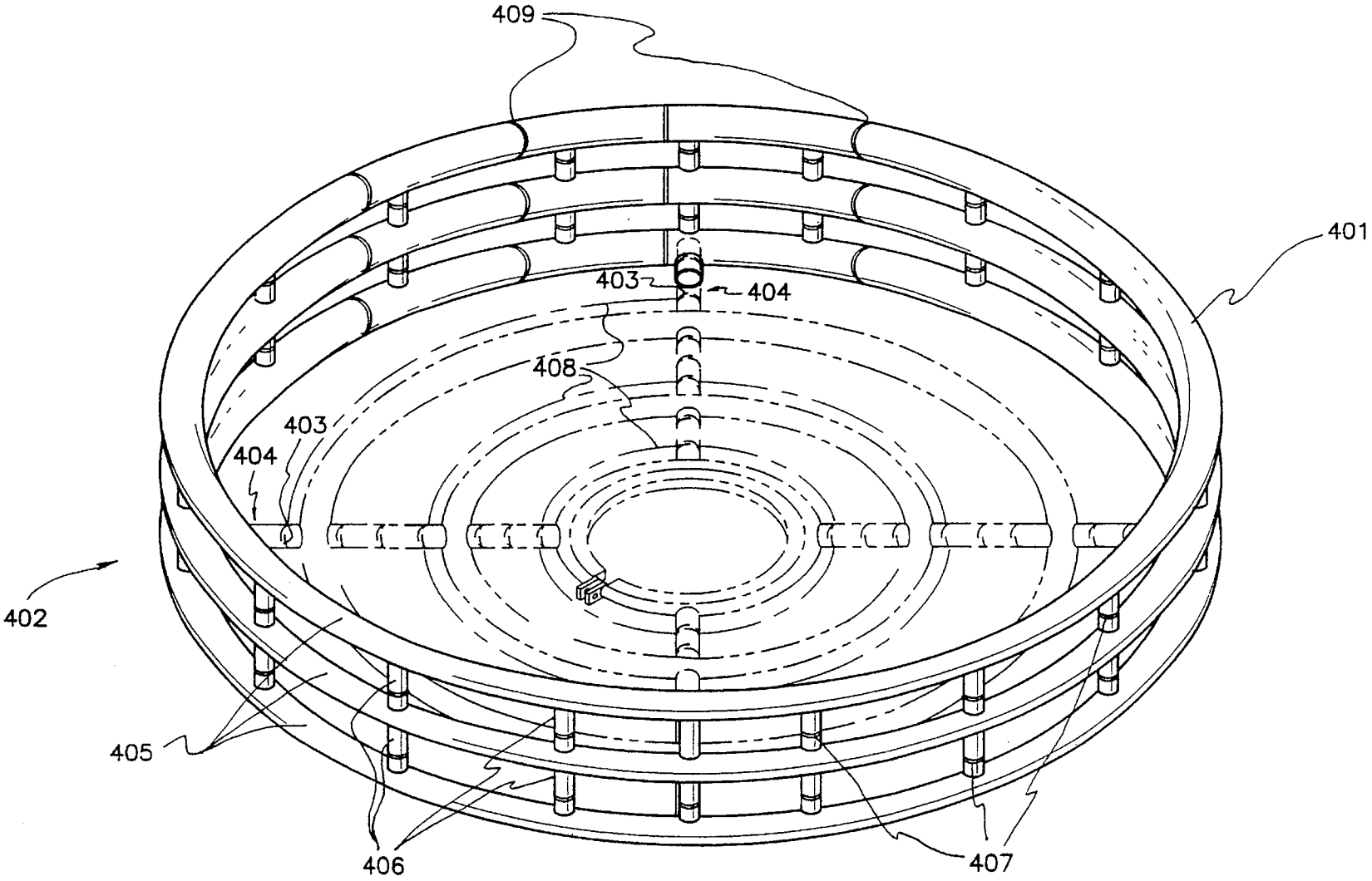
FIG. 4 depicts a top view of an embodiment of a circular fan guard with a fence about the guard's perimeter.

In an alternate embodiment of the invention, a fence may be further affixed to the outer ring of the circular fence. As depicted in FIG. 4, a circular fence 401 is affixed to a circular guard 402 at the notch break point location 403 within the linear radial spacer 404. Fence 401 attaches to the outermost ring 102 (shown in broken lines in FIG. 4 to assist in differentiating fence members from members shown in FIG. 1). The bottommost member 405 of fence 402 may be fastened to spacers 404 in any conventional manner, such as gluing, frictional fit of peg and socket, or any other suitable attachment method. The fence 401 as depicted comprises three levels of circular rings 405 separated by linear radial spacers 406. The linear radial spacers are equally spaced about the circumference of the fence and include notches 407 therein. The notches 407 run about midway into the linear radial spacers and are used as a breaking point of the linear radial spacer. By breaking the linear radial spacers 406 at the notches 407, the height of the fence 401 can be lowered to accommodate a fan positioned close to the ceiling. In addition, the circular rings 405 of fence 401 include perimeter notches 409 therein for breaking the continuity of the perimeter of the fence, thereby allowing the removal of a portion of the fence perimeter and shortening the circumference of the fence. When shortening, the perimeter of the fence will equal the perimeter of a circle 408 created by linear radial spacers broken at their respective notch points. Fan blade guard 101 and fence 401 may be fabricated entirely from a metal, wood, or plastic. Alternatively, fan blade guard 101 and fence 401 may be fabricated from a combination of any of metal, wood, and plastic.

While the invention is described with respect to two embodiments, it is appreciated that numerous embodiments exist as may be known to one skilled in the art. It therefore should be understood that within the scope of the appended claims, the invention may be practiced otherwise than as specifically described therein.

What is claimed is:

1. A variable size circular fan blade guard comprising:

a circular guard securing means located at the center of said circular guard for affixing said fan blade guard to a fan housing, said circular guard securing means comprising positioning means for positioning said fan blade guard with respect to a fan and fastening means for attaching said fan blade guard to the fan;

a circular body comprising concentrically arranged circular rings extending centered with respect to and about said circular guard securing means and held in place by linear radial pieces extending linearly outwardly from said circular guard securing means, said linear radial pieces including notches within the body of each one of said linear radial pieces, said notches being equally spaced from said circular guard securing means and used for removing an outermost said circular ring from said fan blade guard by breaking said linear radial pieces at said notches, and thereby shortening the diameter of said fan blade guard.

2. A fan blade guard according to claim 1, wherein said circular guard is composed of one of a metal, plastic, and wood.

3. A fan blade guard according to claim 1, wherein said circular guard is composed of a combination of at least two of a metal, plastic, and wood.

4. A fan blade guard according to claim 1, wherein said fastening means comprises a combination of male and female threaded fasteners.

5. A fan blade guard according to claim 1, wherein said fastening means further comprises an attachment member split to define two ends, there being a first flange extending perpendicularly outwardly from one of said ends and a second flange extending perpendicularly outwardly from the other one of said ends, said first flange and said second flange each having a hole formed therein for accepting a threaded fastener.

6. A variable size circular fan blade guard comprising:

a circular guard securing means located at the center of said circular guard for affixing said fan blade guard to a fan housing, said circular guard securing means comprising positioning means for positioning said fan blade guard with respect to a fan and fastening means for attaching said fan blade guard to the fan;

a circular body comprising concentrically arranged circular rings extending centered with respect to and about said circular guard securing means and held in place by linear radial pieces extending linearly outwardly from said circular guard securing means, said linear radial pieces including notches within each one of said linear radial pieces, said notches being equally spaced from said circular guard securing means and used for removing an outermost said circular ring from said fan blade guard by breaking said linear radial pieces at said notches, and thereby shortening the diameter of said fan blade guard; and a border fence for radially enclosing the fan blade, said border fence comprising second circular rings equidistantly spaced from one another and second linear radial spacers for spacing apart said second circular rings from one another, said second linear radial Spacers having notches formed therein for modifying the length of said second linear radial spacers, whereby breaking said second linear radial spacers at said notches shortens the length of said second linear radial spacers and hence also shortens the perimeter of said border fence, thereby enabling the perimeter of said border fence to be adjusted to approximately equal the perimeter of a selected said circular body.

7. A fan blade guard according to claim 6, wherein said circular body and said fence are composed of one of a metal, plastic, or wood.

8. A fan blade guard according to claim 6, wherein said circular body and said fence are composed of a combination of at least two of a metal, plastic, and wood.

9. A fan blade guard according to claim 6, wherein said fastening means comprises a combination of male and female threaded fasteners.

10. A fan blade guard according to claim 6, where in said fastening means further comprises an attachment member split to define two ends there being a first flange extending perpendicularly outwardly from one of said ends and a second flange extending perpendicularly outwardly from the other one of said ends, said first flange and said second flange each having a hole formed therein for accepting a threaded fastener.

* * * * *